US006923716B2

(12) United States Patent
Koeger

(10) Patent No.: US 6,923,716 B2
(45) Date of Patent: Aug. 2, 2005

(54) SYSTEM AND METHOD FOR PROTECTION AGAINST NUCLEAR, BIOLOGICAL AND CHEMICAL (NBC) CONTAMINATION

(75) Inventor: Samuel Koeger, Zikhron Yaaqov (IL)

(73) Assignee: Beth-El Zikhron-Ya'Aqov Industries Ltd., Zikhron Yaaqov (IL)

( * ) Notice: Subject to any disclaimer, the term of this patent is extended or adjusted under 35 U.S.C. 154(b) by 143 days.

(21) Appl. No.: 10/622,430

(22) Filed: Jul. 21, 2003

(65) Prior Publication Data

US 2005/0048908 A1 Mar. 3, 2005

(30) Foreign Application Priority Data

Aug. 21, 2002 (IL) ..... 151364

(51) Int. Cl.[7] ..... F24F 7/007
(52) U.S. Cl. ..... 454/230; 454/902; 454/187
(58) Field of Search ..... 454/230, 187, 454/902, 256, 229

(56) References Cited

U.S. PATENT DOCUMENTS 3,294,480 A * 12/1966 Potapenko ..... 422/120
3,766,844 A * 10/1973 Donnelly et al. ..... 454/238
4,558,636 A * 12/1985 Malmstrom et al. ..... 454/338
4,581,986 A * 4/1986 Conklin et al. ..... 454/187
4,631,872 A * 12/1986 Daroga ..... 52/1
6,554,013 B2 * 4/2003 Brown ..... 135/93
6,623,351 B2 * 9/2003 Brown ..... 454/187

* cited by examiner

*Primary Examiner*—Derek S. Boles
(74) *Attorney, Agent, or Firm*—Jacobson Holman PLLC

(57) ABSTRACT

The invention provides an NBC protection and decontamination system, having a space delimited by an enclosure, the enclosure having a clean air inlet port and an air outlet, a decontamination unit attachable to the outside of the enclosure, the decontamination unit having a plenum and a chamber separated from the plenum by an air flow laminator. The system also includes at least one air inlet valve communicating with the air outlet of the enclosure and leading to the plenum and to at least one air exhaust valve made in the chamber, spaced apart from the air inlet valve. An opening is provided for controlled passage between the enclosure and the decontamination unit, and also an opening in the decontamination unit, for controlling the passage between the unit and the outside. There is also provided an NBC protection and contamination method.

24 Claims, 2 Drawing Sheets

Fig.1.
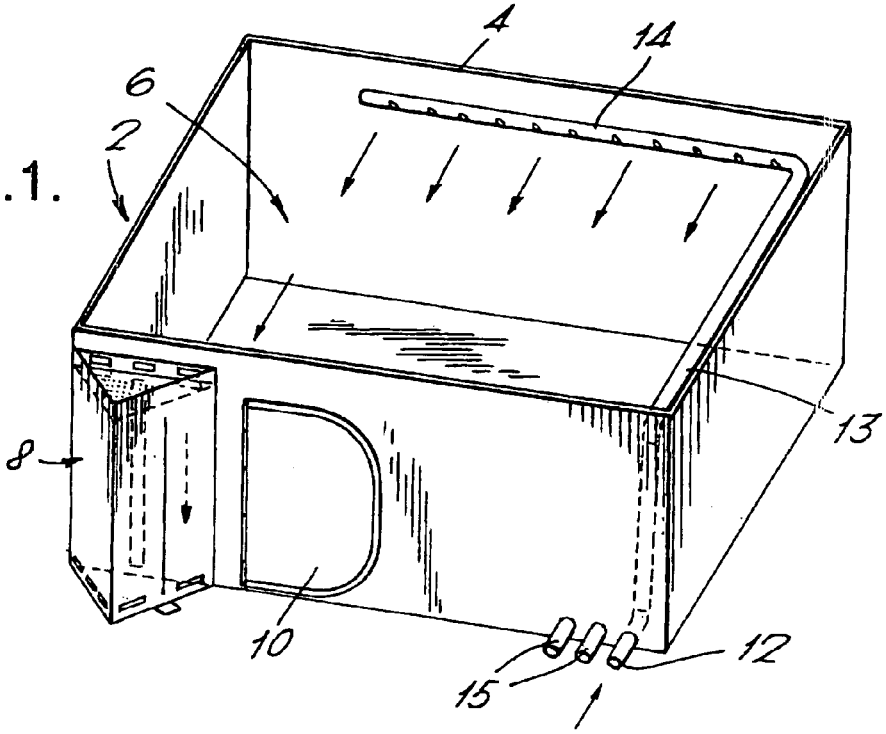
Fig.3.
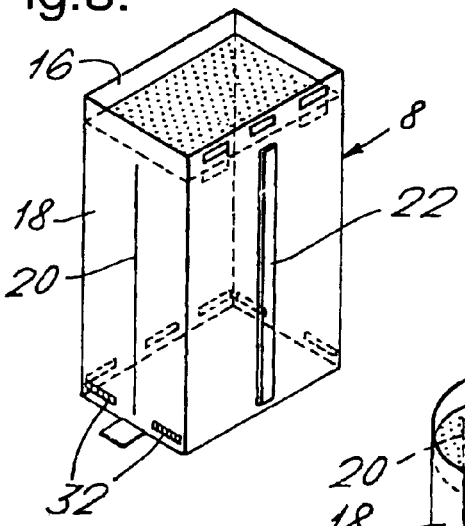
Fig.5.
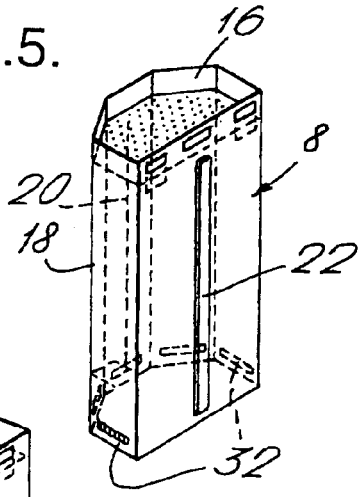
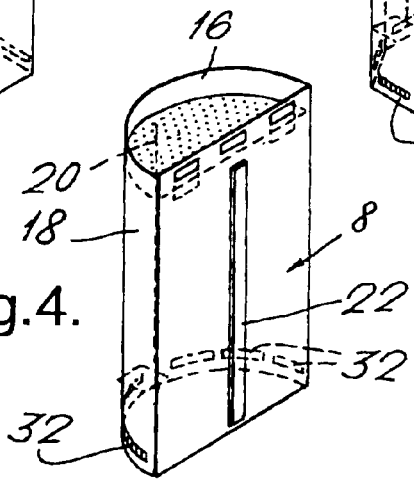
Fig.4.

SYSTEM AND METHOD FOR PROTECTION AGAINST NUCLEAR, BIOLOGICAL AND CHEMICAL (NBC) CONTAMINATION

FIELD OF THE INVENTION

The present invention relates to a system for protection against nuclear, biological and chemical (NBC) contamination, and a method for providing effective flushing and decontamination of NBC agents.

BACKGROUND OF THE INVENTION

As is known, the need for collective protection has recently increased, due to the threat of military attacks and acts of terror using methods and components of chemical or biological warfare. The problem that a contamination-protected space is enclosed always exists; people have to be able to enter and leave a mobile shelter or tent without harming the atmosphere within. One method of solving this problem is to use shelters or protected spaces in which an airlock chamber serves as the entrance or exit. Such an airlock chamber should not only have airlock characteristics, but also should enable decontamination. All contamination adhering to persons and/or other elements entering the protected space must be flushed off as effectively as possible, thereby assuring that no contaminated air will enter the protected space.

To date, air-tight tents having an integrated airlock chamber have not provided effective decontamination within a short period of time. The decontamination method used in prior art shelters of this type is to push clean air into the airlock chamber on one side and to pass it through the airlock chamber, preferably diagonally, to leave the chamber via holes in the wall opposite to the air inlet. The disadvantages of this method are that the airflow has too much turbulence and the length of time needed for decontamination is too long. As a result, the use of such airlock chambers for decontamination is limited. Furthermore, the entrance procedures for using these chambers and their ability to accommodate large numbers of individuals, are also complicated.

DISCLOSURE OF THE INVENTION

It is therefore a broad object of the present invention to ameliorate the above-described and other disadvantages of prior art systems and to provide an NBC decontamination system and a method for protecting enclosed spaces against the penetration of contaminated, hazardous fluids and/or particles.

It is a further object of the invention to provide an airlock decontamination unit suitable for attachment to a wall of an enclosed space to be protected against the penetration of contaminated, hazardous fluids and/or particles.

Accordingly, the present invention provides an NBC protection and decontamination system, comprising a space delimited by an enclosure, said enclosure having a clean air inlet port and an air outlet; a decontamination unit attached or attachable to the outside of said enclosure, said decontamination unit having a plenum and a chamber separated from the plenum by an air flow laminator; at least one air inlet valve communicating with the air outlet of said enclosure and leading to said plenum and to at least one air exhaust valve made in said chamber, spaced apart from said air inlet valve; an opening, providing controlled passage between said enclosure and said decontamination unit, and an opening in said decontamination unit, providing controlled passage between said unit and the outside.

The invention further provides an NBC protection and decontamination system, comprising a space delimited by an enclosure constituted of walls and surfaces, the enclosure having at least one clean air inlet port and at least one air outlet; a decontamination unit attached or attachable to a wall of the enclosure, the decontamination unit having at least one air inlet communicating with the air outlet from the enclosure and at least one air exhaust valve spaced apart from the air inlet; the decontamination unit further having normally closed access openings to the enclosed space and to the outside, the arrangement being such that clean air flow within the space inside the enclosure is directed from one wall to an opposite wall in which the air outlet is located and air inside the decontamination unit is directed substantially from one end of the unit to the other end, so as to produce laminar air flow through the enclosed space and the decontamination unit.

The invention still further provides an NBC protection and decontamination method, comprising providing a system as claimed in claim 1 or claim 21, directing air across the enclosed space towards the decontamination unit through at least one overpressure valve; entering the directed air into the plenum; producing a laminar airflow inside the chamber, and allowing air to exit from the chamber through at least one air exhaust valve.

BRIEF DESCRIPTION OF THE DRAWINGS

The invention will now be described in connection with certain preferred embodiments with reference to the following illustrative figures, so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a schematic isometric view of the decontamination system according to the present invention;

FIG. 2 is an isometric view of the airlock unit of FIG. 1, and

FIGS. 3 to 5 are isometric views of several possible configurations of the airlock unit of FIG. 1.

DETAILED DESCRIPTION OF PREFERRED EMBODIMENTS

Figure 2:
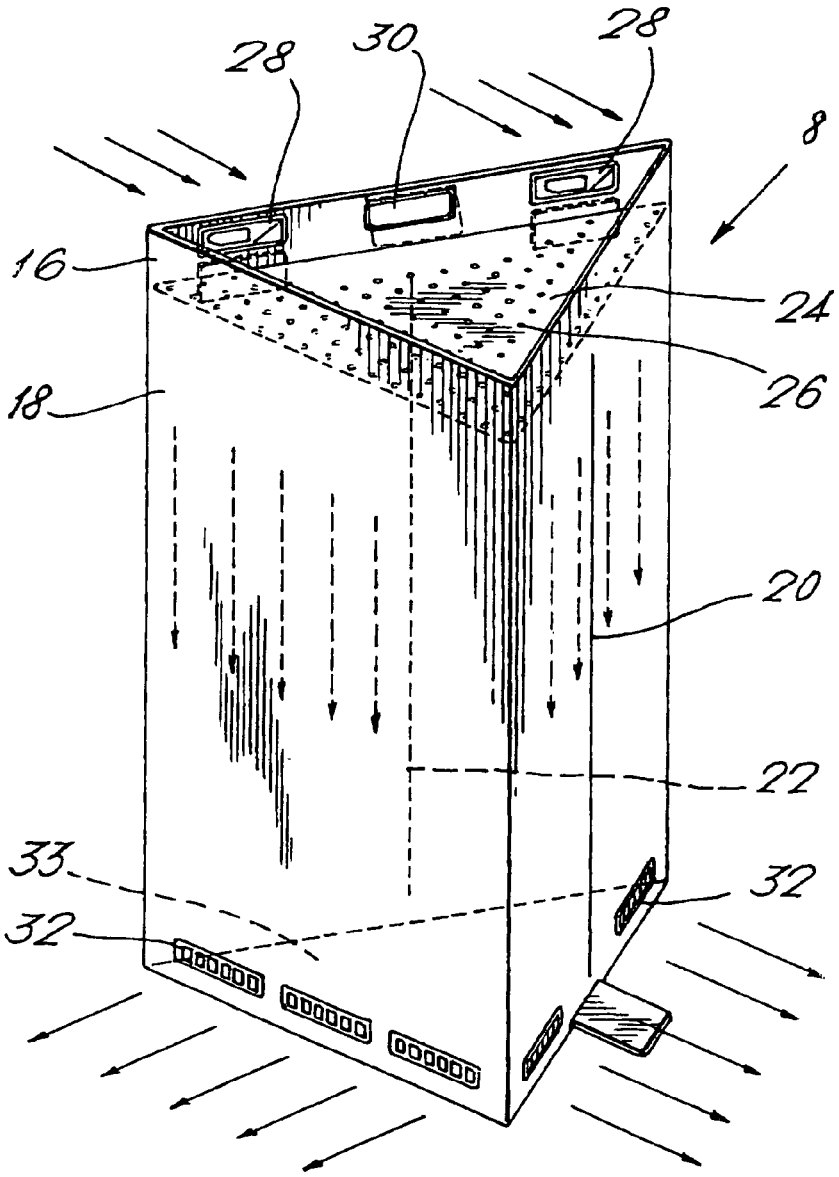

Illustrated in FIG. 1 is a system 2 according to the invention for improving protection against NBC contamination by fluids and/or particles in enclosed spaces. Shown is an enclosure 4, which may be a collapsible tent or a similar structure having fluid-tight walls and surfaces made of flexible material, or an enclosure made of semi-rigid or rigid material or a combination of such materials. The enclosure generates a toxic-free area (TFA) or space 6. The front wall of enclosure 4 is fitted with an airlock decontamination unit 8 and may also include a normally closed door 10. Mechanically and chemically filtered air from the outside enters the TFA through one or more air inlet ports 12 and is guided, through tubes 13, toward the upper portion of space 6 opposite the front wall where the airlock unit is situated. The clean air exits from tube 13 through a manifold 14. Normally closed utility sleeves 15, for the entry of various piping, such as electrical cables, water pipes, and the like, may also be provided.

Turning now to FIG. 2, airlock decontamination unit 8 is illustrated to a larger scale. Unit 8 includes a plenum 16 at its upper portion and a decontamination chamber 18 at is lower portion. Chamber 18 is accessed from the front and back through closable openings 20, 22, which are opened and closed, e.g., by means of zippers, magnetic flaps, Velcro® strips or tapes, or the like. Plenum 16 and chamber 18 are separated by a fluid laminator 24, essentially composed of an array of small apertures 26. The aim of the small apertures 26 of the laminator 24 is also to create an overpressure in the plenum to ensure laminar flow into the chamber. Further shown in FIG. 2 are optionally adjustable over-pressure valves 28 and a safety valve 30, all communicating with plenum 16. The sum of the small apertures 26 are preferably less than 90% of the area of the air inlet of the overpressure valve or valves 28. The amount of the air apertures 26 should advantageously be ten times higher than that of the valves 28. Also, it is of advantage that the sum of the area of the openings 26 be more than 10% of the sum of the area of the opening of the air exhaust valves. Fluid exhaust valves 32 are distributed adjacent to the bottom or floor 33 of chamber 18. The exhaust valves 32 can be made integral with, or affixed to, the floor 33 surface of decontamination unit 8. Preferably the diameter of the opening of the exhaust valves 32 should be less than 10 mm. or a free space less than 70 $mm^2$ per opening.

As can clearly be seen in FIGS. 3 to 5, the configuration of decontamination unit 8 may vary in accordance with structural and/or aesthetic considerations. Hence, unit 8 may be triangular, as shown in FIGS. 1 and 2, rectangular (FIG. 3), semi-circular (FIG. 4), or polygonal (FIG. 5).

The operation of the system will now be described with reference to the figures.

Mechanically and chemically filtered clean air is entered into air inlet port 12 and propelled by pumping or suction through tube 13 to the upper portion of space 6, where it exits through manifold 14 and flows in the direction of the arrows towards the wall opposite the manifold. The clean air then enters the plenum 16 through overpressure valves 28, thus forming an overpressure in the volume of the plenum. The clean air is distributed throughout the volume of the plenum and enters decontamination chamber 18 through apertures 26 in laminator 24. The air eventually exits chamber 18 through exhaust valves 32.

The size of apertures 26 and the pattern of distribution are such that over-pressure air in the plenum produces a well-distributed, laminar airflow in the chamber from top to bottom. The sizes of the inlet and, in particular, the exhaust valves 32, are chosen and can be adjusted so as to provide the desired laminar airflow, producing a satisfactory decontamination effect of persons and/or equipment located inside the chamber 18. It is desired, inter alia, to achieve a more thorough decontamination at a shorter dwelling period of the air, e.g., a dwell/decontamination period of about 2–3 minutes, or even less.

Although the above-described embodiments refer to an enclosure 4 and a separate decontamination unit 8, it should be understood that the enclosure 4 and unit 8 may have a common wall, in which a closable opening is made. Unit 8 may be attached to enclosure 4 by means of one or more zippers, or the like, or directly integrally made or permanently attached to the enclosure 4, e.g., by welding.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An NBC protection and decontamination system, comprising:

a space delimited by an enclosure, said enclosure having a clean air inlet port and an air outlet;

a decontamination unit attached or attachable to the outside of said enclosure, said decontamination unit having a plenum and a chamber separated from the plenum by an air flow laminator; at least one air inlet valve communicating with the air outlet of said enclosure and leading to said plenum and to at least one air exhaust valve made in said chamber, spaced apart from said air inlet valve;

an opening, providing controlled passage between said enclosure and said decontamination unit, and an opening in said decontamination unit, providing controlled passage between said unit and the outside.

2. The NBC protection and decontamination system as claimed in claim 1, wherein said plenum is located above said chamber.

3. The NBC protection and decontamination system as claimed in claim 2, wherein said air outlet is associated with said plenum.

4. The NBC protection and decontamination system as claimed in claim 1, wherein the air inside said enclosure is distributed via an air manifold.

5. The NBC protection and decontamination system as claimed in claim 1, wherein said air outlet is an over-pressure valve.

6. The NBC protection and decontamination system as claimed in claim 1, wherein at least one of said openings is a closable opening.

7. The NBC protection and decontamination system as claimed in claim 1, wherein said enclosure is further provided with a closable door providing a direct passageway into and from the space within said enclosure.

8. The NBC protection and decontamination system as claimed in claim 1, wherein at least some of said walls and surfaces are made of flexible material.

9. The NBC protection and decontamination system as claimed in claim 1, wherein said enclosure is a collapsible tent.

10. The NBC protection and decontamination system as claimed in claim 1, wherein said air outlet is located along an upper wall of said enclosure, opposite said air inlet.

11. The NBC protection and decontamination system as claimed in claim 1, wherein the air inlet of said decontamination unit is an over-pressure valve.

12. The NBC protection and decontamination system as claimed in claim 1, wherein said decontamination unit is composed of an upper plenum communicating with said air outlet and a chamber communicating with said air exhaust valve, said plenum and said chamber being separated from each other by an air laminator.

13. The NBC protection and decontamination system as claimed in claim 1, wherein said access openings are closable by means of zippers, magnetic flaps or Velcro® strips or tapes.

14. The NBC protection and decontamination system as claimed in claim 1, wherein said exhaust valves are made integrally with, or are affixed to, the floor of said decontamination unit.

15. The NBC protection and decontamination system as claimed in claim 12, wherein said air laminator is formed by a plurality of small apertures distributed about at least a major cross-sectional area of said chamber.

16. The NBC protection and decontamination system as claimed in claim 15, wherein said small apertures are configured to create an overpressure in said plenum relative to the pressure in the chamber.

17. The NBC protection and decontamination system as claimed in claim 12, wherein the sum of the areas of said small apertures is less than 90% of the area of the air inlet to said plenum.

18. The NBC protection and decontamination system as claimed in claim 12, wherein the number of said small apertures is more than 10 times greater than the number of air inlets to the plenum.

19. The NBC protection and decontamination system as claimed in claim 1, wherein air exhaust openings from the chamber have a diameter less than 10 mm, or a free space less than 70 $mm^2$ per opening.

20. The NBC protection and decontamination system as claimed in claim 12, wherein the sum of the areas of said small apertures is more than 10% than the sum of the areas of air openings of said exhaust valves.

21. An NBC protection and decontamination system, comprising:

a space delimited by an enclosure constituted of walls and surfaces, said enclosure having at least one clean air inlet port and at least one air outlet;

a decontamination unit attached to a wall of said enclosure, said decontamination unit having at least one air inlet communicating with said air outlet from the enclosure and at least one air exhaust valve spaced apart from said air inlet;

said decontamination unit further having normally closed access openings to the enclosed space and to the outside;

the arrangement being such that clean air flow within the space inside said enclosure is directed from one wall to an opposite wall in which said air outlet is located and air inside said decontamination unit is directed substantially from one end of the unit to the other end, so as to produce laminar air flow through said enclosed space and said decontamination unit.

22. An NBC protection and decontamination method, comprising:

providing a system as claimed in claim 1;

directing air across said enclosed space towards said decontamination unit through at least one overpressure valve;

entering the directed air into said plenum;

producing a laminar airflow inside said chamber, and allowing air to exit from said chamber through at least one air exhaust valve.

23. The NBC protection and decontamination method as claimed in claim 22, wherein said plenum is located above said chamber and laminar air flow is directed from the top of said decontamination unit to its bottom.

24. The NBC protection and decontamination method as claimed in claim 22, wherein the space inside said enclosure can be accessed only via said decontamination unit.

* * * * *